US009427040B2

(12) United States Patent
Leyland et al.

(10) Patent No.: US 9,427,040 B2
(45) Date of Patent: Aug. 30, 2016

(54) HEADGEAR SUPPORT DEVICE HAVING FRONT-BACK ADJUSTMENT

(75) Inventors: Sally Leyland, Apleton (GB); Christopher Hall, Preston (GB)

(73) Assignee: Scott Health & Safety Limited, Skelmersdale (GB)

( * ) Notice: Subject to any disclaimer, the term of this patent is extended or adjusted under 35 U.S.C. 154(b) by 753 days.

(21) Appl. No.: 13/697,307

(22) PCT Filed: May 11, 2011

(86) PCT No.: PCT/GB2011/050896

§ 371 (c)(1),
(2), (4) Date: Apr. 8, 2013

(87) PCT Pub. No.: WO2011/141733

PCT Pub. Date: Nov. 17, 2011

(65) Prior Publication Data

US 2013/0205474 A1 Aug. 15, 2013

Related U.S. Application Data

(60) Provisional application No. 61/333,315, filed on May 11, 2010.

(51) Int. Cl.

| | |
|---|---|
| ***A42C 5/00*** | (2006.01) |
| ***A42B 3/22*** | (2006.01) |
| ***A42B 3/04*** | (2006.01) |

(52) U.S. Cl.

CPC . *A42C 5/00* (2013.01); *A42B 3/04* (2013.01); *A42B 3/221* (2013.01); *A42B 3/225* (2013.01)

(58) Field of Classification Search

CPC ..... A42B 3/04; A42B 3/225; A42B 3/14; A42B 3/145; Y10T 403/75

USPC ..... 2/416

See application file for complete search history.

(56) References Cited

U.S. PATENT DOCUMENTS

| | | | | | |
|---|---|---|---|---|---|
| 1,601,830 | A | * | 10/1926 | Huntsman | 2/8.2 |
| 2,283,120 | A | * | 5/1942 | Malcom | 2/8.1 |
| 2,320,244 | A | * | 5/1943 | Maillart | 2/8.1 |
| 2,390,006 | A | * | 11/1945 | Severy | 2/8.1 |
| 2,788,558 | A | * | 4/1957 | Bowers, Jr. | 24/669 |
| 2,814,043 | A | | 11/1957 | Alesi | |
| 3,074,072 | A | * | 1/1963 | Edwards et al. | 2/8.1 |
| 3,075,201 | A | * | 1/1963 | Lindblom | 2/8.1 |
| 3,430,262 | A | * | 3/1969 | Raschke | 2/8.1 |
| 3,430,263 | A | * | 3/1969 | Newcomb | 2/8.1 |
| 3,866,244 | A | * | 2/1975 | Ruck | 2/8.1 |
| 5,077,836 | A | * | 1/1992 | Idoff et al. | 2/10 |
| 5,571,217 | A | * | 11/1996 | Del Bon et al. | 2/9 |
| 5,813,049 | A | | 9/1998 | Xu | |

(Continued)

*Primary Examiner* — Richale Quinn

(74) *Attorney, Agent, or Firm* — Wyatt B. Pratt

(57) ABSTRACT

A headgear support device (109) supports a face shield (160). The device includes a headband (106) having an elongated slot (103) and a pivot element (120) which is affixed to the face shield (160). The pivot element is slidably located within the slot to enable translational movement of the face shield. The pivot element is also rotatable within the slot to enable rotational movement of the face shield. The device also includes a retaining element for retaining the pivot element in the slot to enable translational movement of the pivot element and face shield. Translational movement of the pivot element enables the face shield to be positioned closer to, or further from, a user's face in order to provide greater comfort for the user.

11 Claims, 7 Drawing Sheets

(56) References Cited

U.S. PATENT DOCUMENTS

| | | | | |
|---|---|---|---|---|
| 6,260,197 | B1 * | 7/2001 | Hoogewind | 2/8.3 |
| 6,341,382 | B1 | 1/2002 | Ryvin et al. | |
| 7,120,939 | B1 * | 10/2006 | Howard et al. | 2/416 |
| 8,387,162 | B2 * | 3/2013 | Huh | 2/8.2 |
| 8,745,770 | B2 * | 6/2014 | Ahlgren et al. | 2/417 |
| 8,875,318 | B2 * | 11/2014 | Huh | 2/421 |
| 2006/0080761 | A1 * | 4/2006 | Huh | 2/424 |
| 2007/0245467 | A1 * | 10/2007 | Lilenthal et al. | 2/416 |
| 2008/0184451 | A1 * | 8/2008 | Lemke et al. | 2/8.2 |
| 2010/0212058 | A1 * | 8/2010 | Wanhainen | 2/8.2 |
| 2010/0223707 | A1 * | 9/2010 | Moyses | 2/8.2 |
| 2011/0302701 | A1 * | 12/2011 | Kuo | 2/421 |

* cited by examiner

HEADGEAR SUPPORT DEVICE HAVING FRONT-BACK ADJUSTMENT

This invention relates to headgear support device for use with protective headgear having a face shield, and more particularly, a headgear support device which provides front-back adjustment.

Protective headgear typically includes headgear supports with headbands or head straps that are adjustable to provide the headgear with a comfortable fit on a wide range of head sizes. The headgear may also include a visor or mask shell which serves to protect the user. The visor is typically rotatably mounted onto a helmet or other protective headgear to enable rotation of the visor up and away from the user's face. It has been found such visors provide discomfort to the user when the visor is in the down position. Therefore, it would be desirable to provide a headgear arrangement which provides greater comfort to the user.

A headgear support device for supporting a visor is disclosed. The device includes a headband having an elongated slot and a pivot element which is affixed to the visor or mask shell. The pivot element is slidably located within the slot to enable translational movement of the visor or mask shell. The pivot element is also rotatable within the slot to enable rotational movement of the visor or mask shell. The device also includes a retaining element for retaining the pivot element in the slot to enable translational movement of the pivot element and visor.

Figure 3:
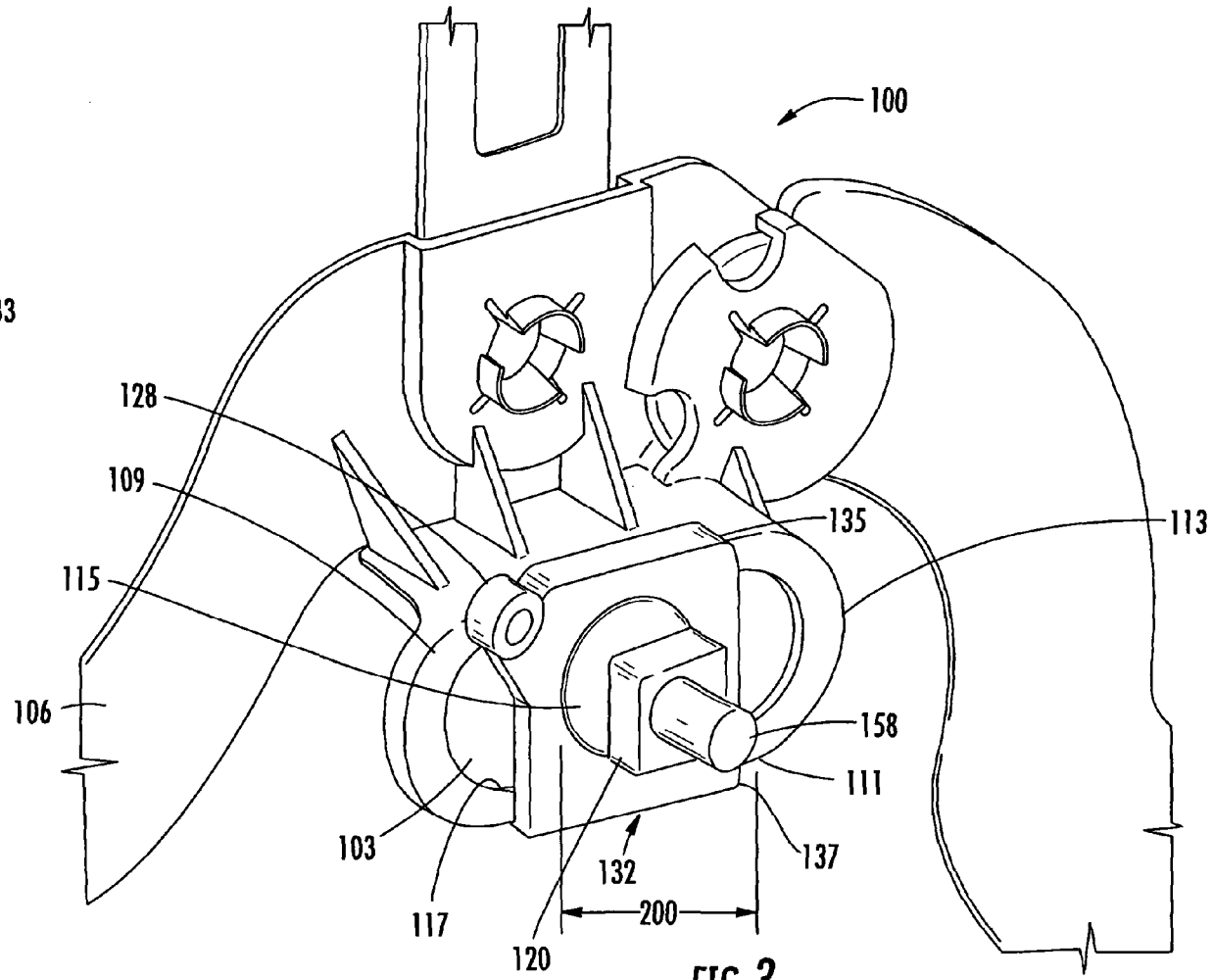
FIG. 3 shows the headgear support device and a pivot link.
Figure 3A:
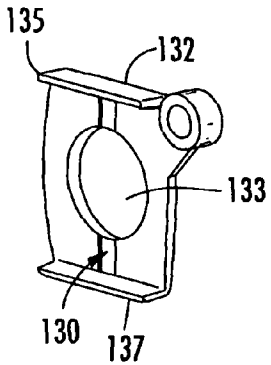

FIG. 3*a* shows a rear portion of the pivot link.

Figure 4:
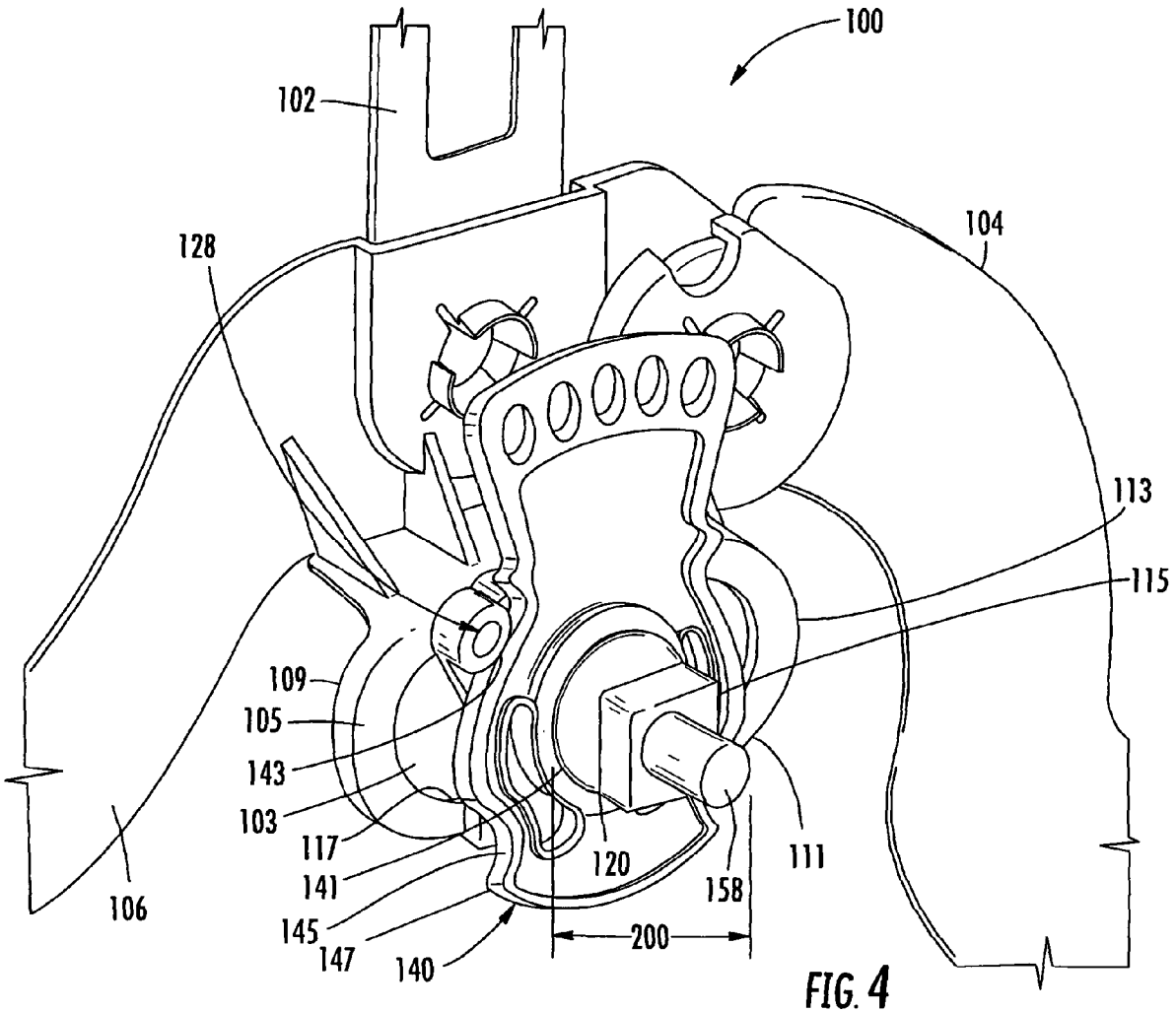

FIG. 4 is a view of the headgear support device and a pivot stop located in a substantially vertical position.

Figure 5:
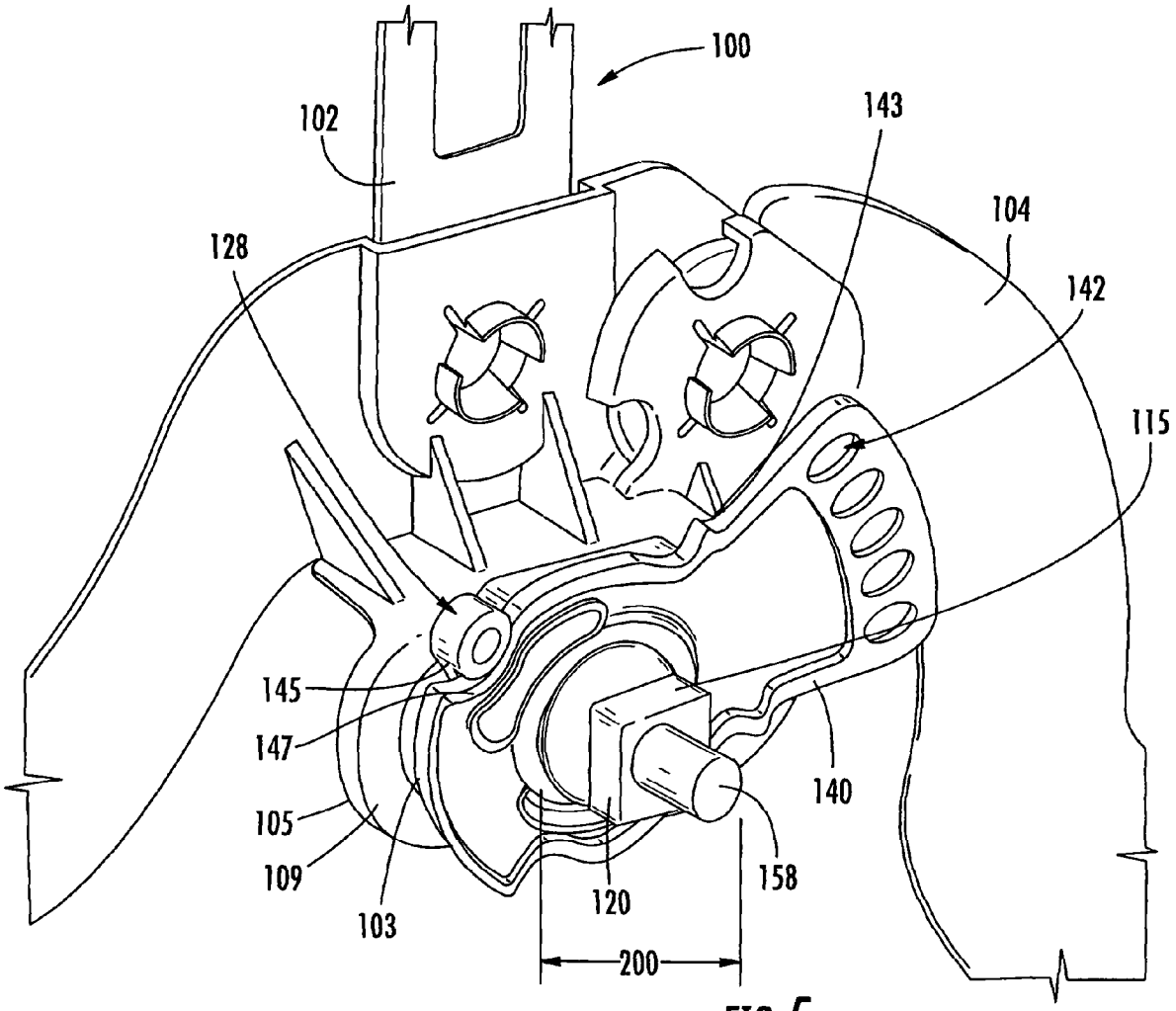

FIG. 5 is a view of the pivot stop in a substantially horizontal position wherein a peg is received in a lower recess.

Figure 6:
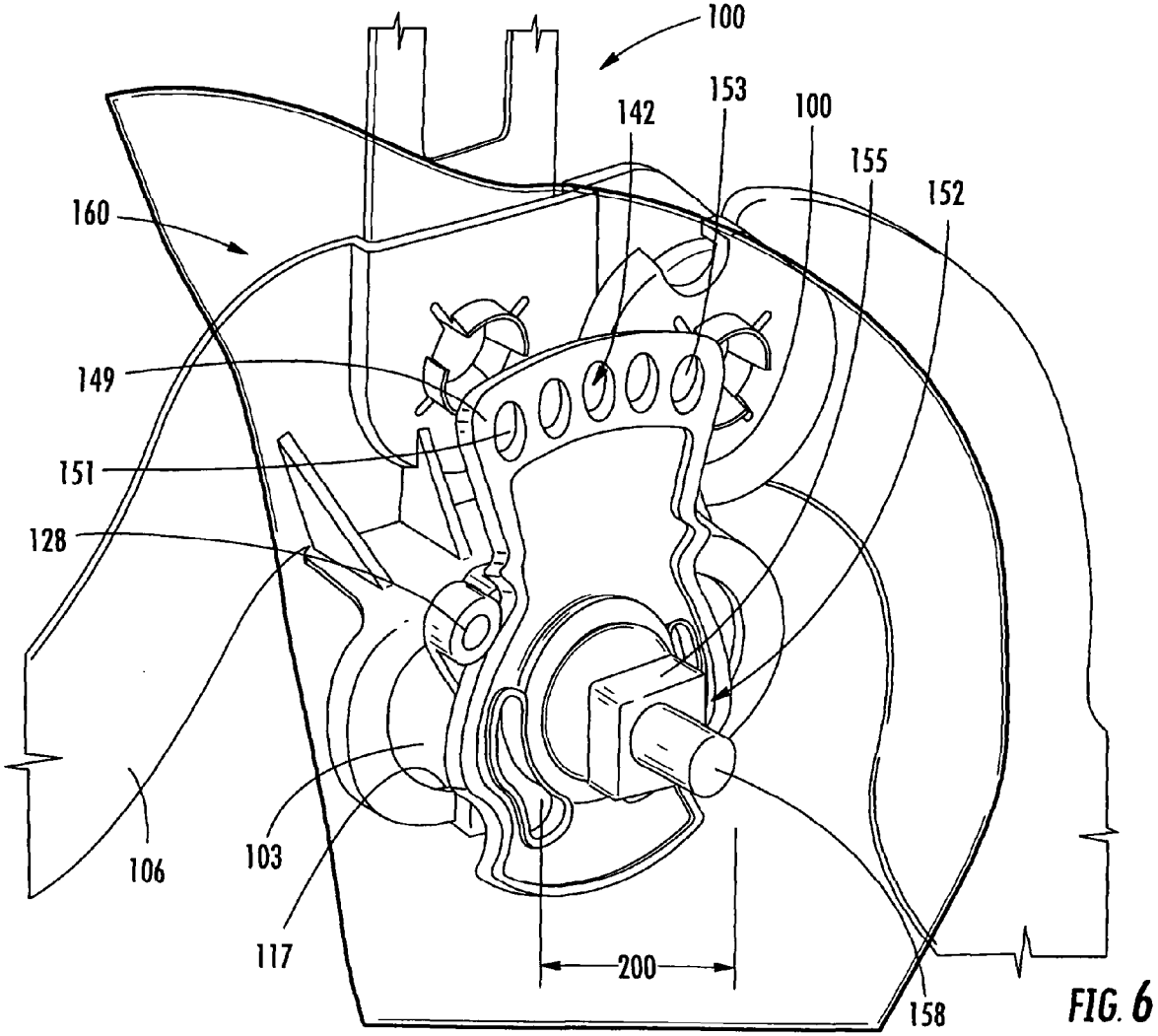

FIG. 6 is a view of a portion of a visor attached to the headgear support device.

Figure 7:
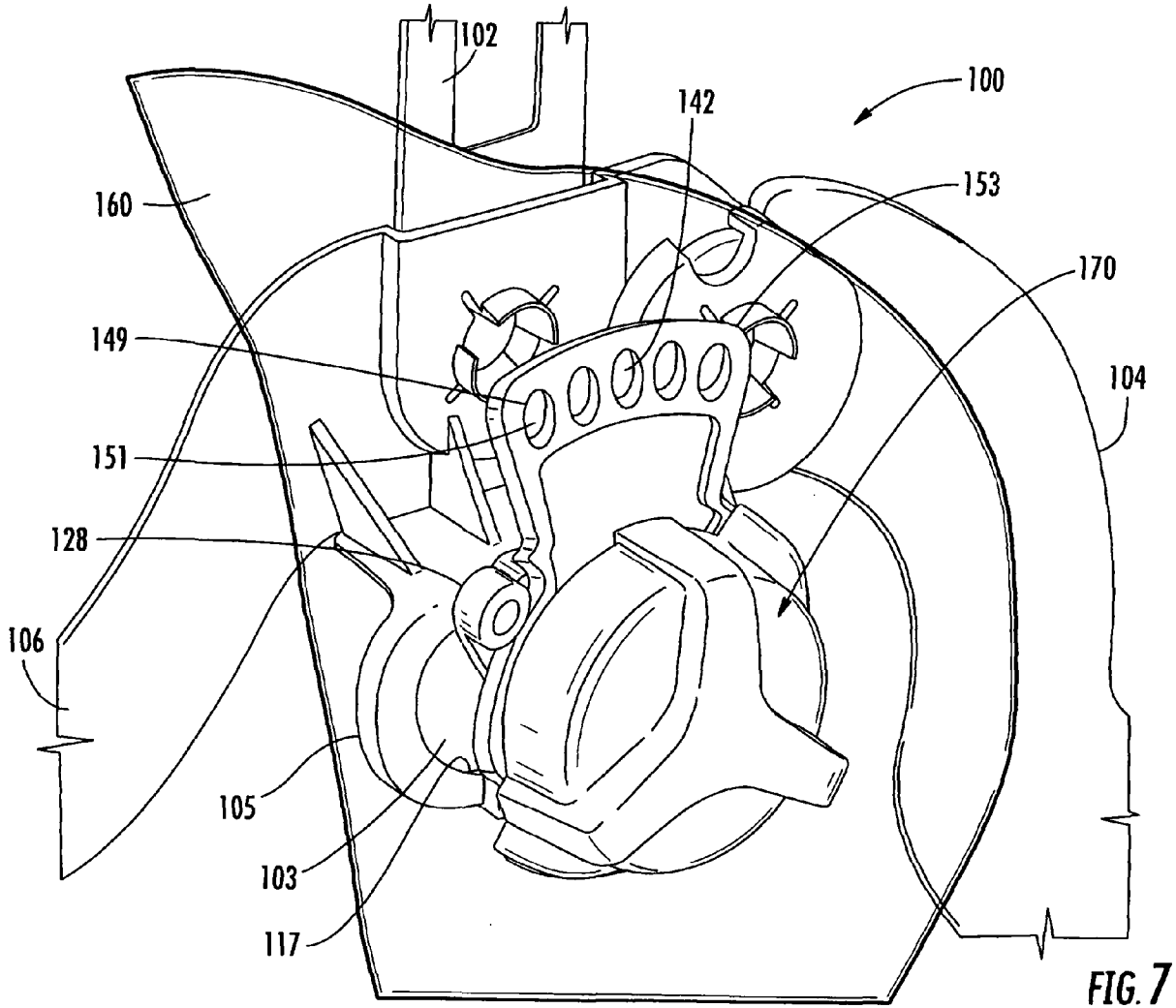

FIG. 7 depicts a knob for tightening or loosening the visor.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-7.

Figure 1:
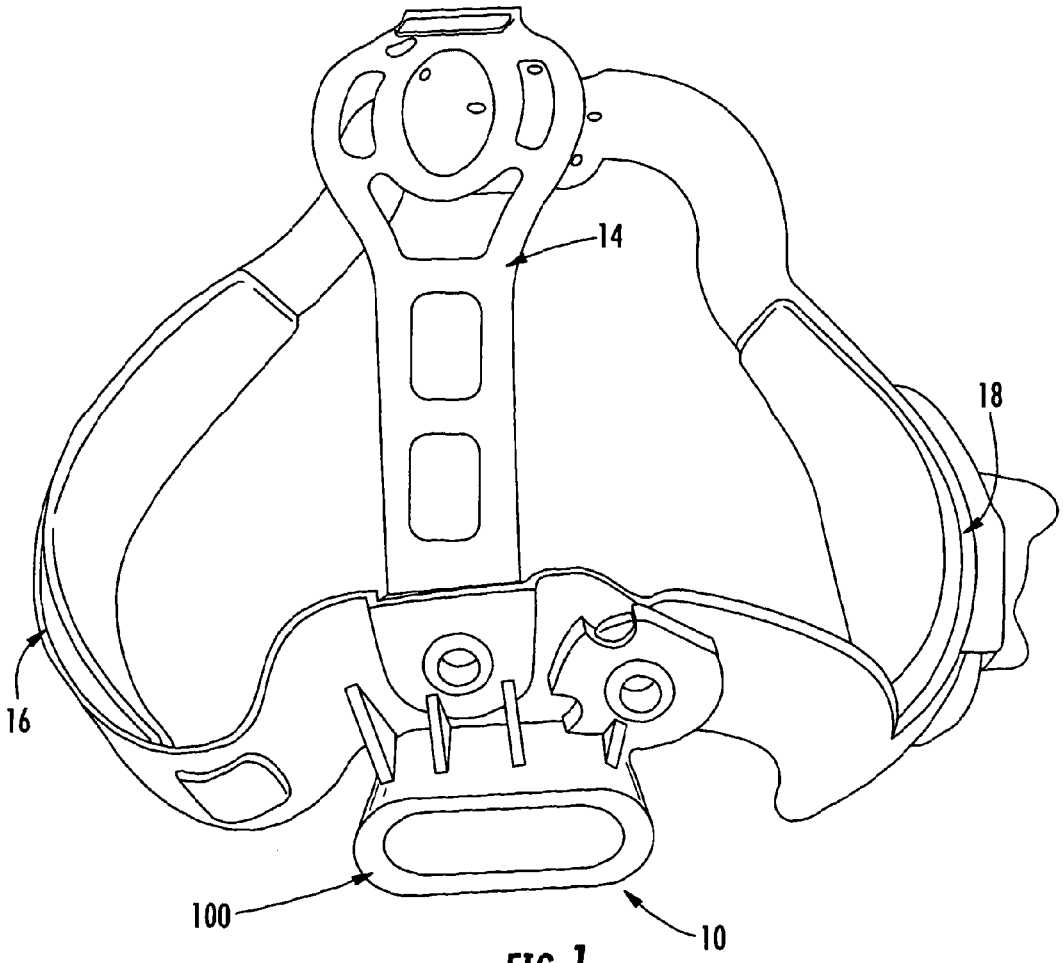
FIG. 1 depicts a head top support system.

Referring to FIG. 1, a head top support system 10 is shown which is constructed in three sectional pieces. The system 10 includes an overhead support band 14, a frontal head support band 16 and a rear head support band 18. The overhead support band 14 and rear head support band 18 moves independently relative to the frontal head support band 16. The three section headgear support is designed to be used with a variety of different types of protective headgear. Representative functional protective structures include welding, brow guard face protection visor, air fed face shield, combinations of these structures, and the like.

The overhead support band 14 is positioned approximately ninety degrees from the frontal head support band 16. The overhead support band 14, frontal head support band 16 and rear head support band 18 are connected at a first and second common connection area. The common connection area allows the three sections to move relative to each other while maintaining restrictions within that movement. The overhead support band 14 preferably has an angular range of movement of from about ten degrees or less from the frontal head support band 16. This range of movement allows proper adjustment of the system 10 on the head of the wearer of the protective head covering while permitting balance and comfortable fit of the protective head covering. The rear head support band 18 has an angular range of movement of from about forty-five degrees or less relative to the overhead support band 14, allowing the rear support band 18 to properly adjust at the base of the back of the user's head. Preferably, both the overhead support band 14 and rear support band 18 include a length changing mechanism. In the rear support band 18 a ratchet mechanism is preferred and used to ensure that the rear support band 18 is inhibited from moving too far up the user's head, regardless of size, which would compromise the reliability of the user to retain the protective head covering during use. Length adjustment of the overhead support band 14 allows proper fitting of the system 10 on multiple users with different head sizes.

Figure 2:
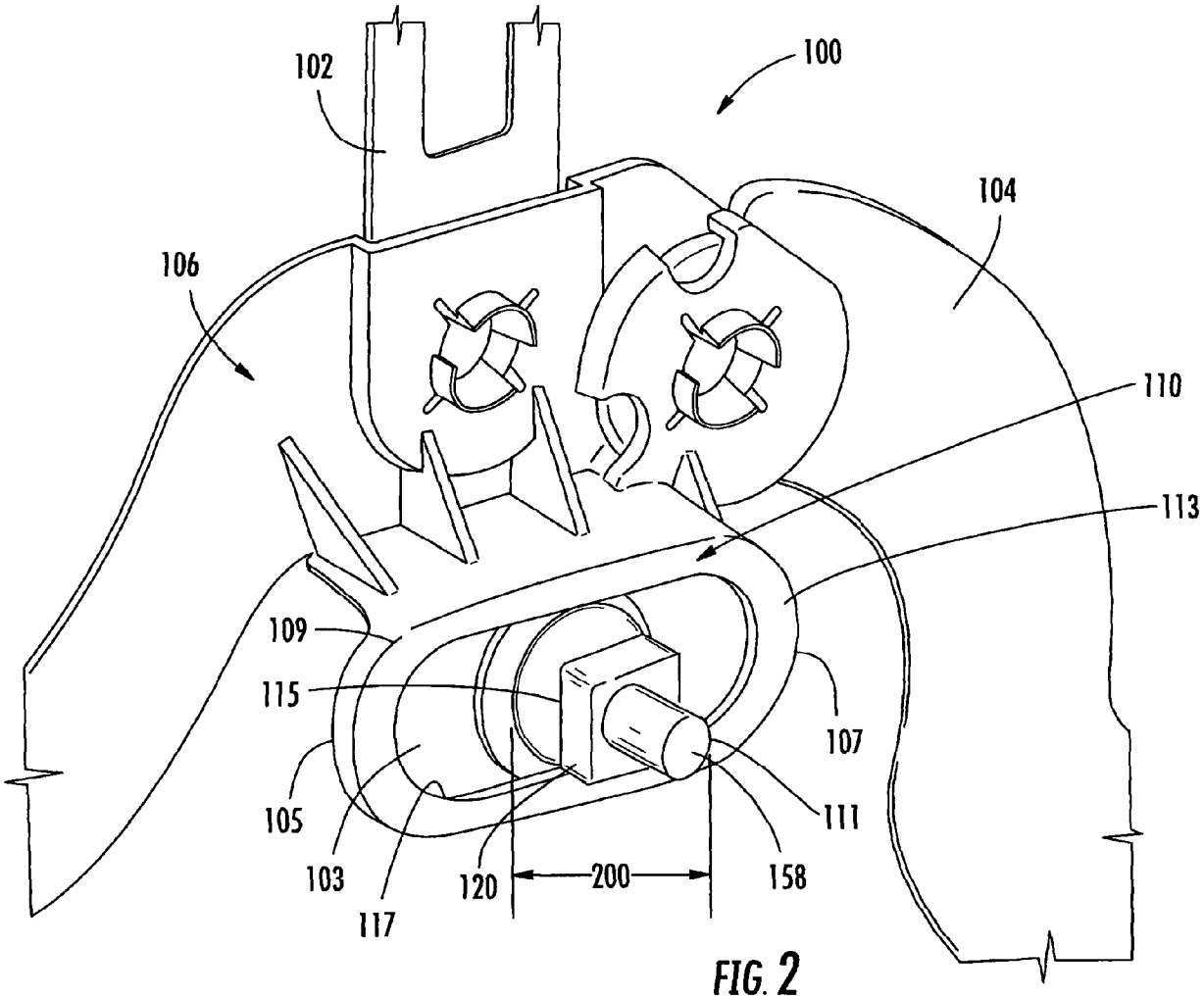
FIG. 2 depicts a headgear support device in accordance with the present invention.

Referring to FIG. 2, a headgear support device 100 in accordance with the present invention is shown. The device 100 includes a headband 106 for accommodating a user's head (only a portion of the headband 106 is shown). The headband 106 includes a pivot stud 120 which is located within an elongated slot 103. The pivot stud 120 is slidable within the slot 103. In accordance with the present invention, translational movement of the pivot stud 120 toward a front end 105 of the slot 103 moves a mask or visor shell either further from a user's face. Conversely, translational movement of the pivot stud 120 towards a rear end 107 of the slot 103 moves the visor closer to a user's face. In FIG. 2, the translation movement of the pivot stud 120 is shown by arrow 200 to denote front to back adjustment. Thus, a user may adjust the visor as desired in order to provide greater comfort. In one embodiment, the range of the front to back adjustment is approximately 25 mm.

Top 109 and bottom 111 portions of a perimeter portion 113 of the slot 103 include a plurality of spaced apart sunken or subsurface portions which serve as adjustment stops 110. The adjustment stops 110 offer guidance to a user regarding a position of a visor or mask shell (collectively referred to as a face shield) relative to the user's face. The pivot stud 120 further includes a round shoulder 115 which rotates relative to an inner surface 117 of the perimeter portion 113 to also enable rotation of the pivot stud 120 relative to the headband 106.

Referring to FIG. 3, the headgear support device 100 further includes a pivot link 132 (shown in a semi-transparent view) which is located on the pivot stud 120. Referring to FIG. 3*a*, a rear portion of the pivot link 132 is shown. The pivot link 132 includes a hole 133 which is adapted to mount on the round shoulder 115 of the pivot stud 120. The pivot link 132 includes upper 135 and lower 137 guide elements which fit over and accommodate the top 109 and bottom 111 portions of the perimeter portion 113 to thus enable the pivot stud 120 to slide within the slot 103. An internal surface of the pivot link 132 includes raised portions 130 (shown in FIG. 3*a*) which serve to engage with the sunken or sub surfaces of the adjustment stops 110 to thus locate the pivot stud 120 in the slot 103 relative to the headband 106.

Referring to FIG. 4, the headgear support device 100 also includes a pivot stop 140 located in a substantially vertical position. The pivot stop 140 is attached to a mask or visor shell of a helmet or other protective headgear. The pivot stop 140 includes a hole 141 for accommodating the round shoulder 115 of the pivot stud 120 to enable rotation of the pivot stop 140 and thus the mask or visor shell relative to the headgear 106. The pivot stop 140 includes upper 143 and lower 145 recesses having a substantially semicircular shape for accommodating a stationary location peg 128 which extends from the pivot link 132. In FIG. 4, the peg 128 is shown located within the upper recess 143 to thus stop rotation of the visor when the face shield is in the down position.

Referring to FIG. 5, the pivot stop 140 is shown rotated in a substantially horizontal position wherein the face shield is in the up (raised) position. In this position, the peg 128 is received in the lower recess 145 to thus stop rotation of the face shield when the face shield is in the up position. The lower recess 145 further includes an upturned end portion 147 (see FIG. 4). The lower recess 145, upturned end portion 147 and peg 128 are configured to retain the peg 128 such that face shield is held in the up position. In one embodiment, the design and natural spring of the material used to fabricate the pivot stop 140 create a retaining force on the peg 128.

Referring to FIG. 6, a semi-transparent view of a portion of a face shield 160 is shown attached to the headgear support device 100. In particular, the visor 160 includes a square location hole 155 which receives a square portion 152 of the pivot stud 120. As previously described, the pivot stud 120 rotates relative to the headband 106. This causes corresponding rotation of the square portion 152 and the face shield 160. The face shield 160 includes a location pin 142 which is adapted to engage one of a plurality of location slots 149 formed in the pivot stop 140. In particular, positioning of the locating pin 142 in the location slots 149 from a front locating slot 151 to a rear locating slot 153 progressively opens the face shield 160 by increasingly larger amounts to provide angular adjustment of the face shield 160 relative to the user's face.

Referring to FIG. 7, a knob 170 is secured to a projecting portion 158 of the pivot stud 120. The knob 170 serves to tighten or loosen the face shield 160 relative to the headgear support device 100. In operation, a user turns the knob 170 counterclockwise to loosen the headgear support device 100 to enable translational (front to back) 200 adjustment of the headgear support device 100 within the slot 103 such that the visor 160 is positioned a desired distance from the user's face. In addition, the user can rotate the pivot stop 153 and face shield 160 such that the locating pin 142 is inserted into a desired location slot 149 to provide a desired open or closed position for the face shield 160. The user then turns the knob 170 clockwise to tighten the visor 160 to fix the location of the headgear support device 100 within the slot 103 (and thus the front to back adjustment) and the locating pin 142 in a selected slot 149.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

The invention claimed is:

1. A headgear support device for supporting a face shield comprising:

a headband having an elongated slot; and a pivot element affixed to the face shield, wherein the pivot element is slidably located within the slot to enable translational movement of the face shield and wherein the pivot element is also rotatable within the slot to enable rotational movement of the face shield; and a pivot link; wherein the pivot link has a hole therein through which the pivot element extends to locate the pivot link on the pivot element and having upper and lower guide elements which fit over and accommodate top and bottom portions of a perimeter of the slot such that the pivot link is constrained for sliding movement relative to the slot with the pivot element, a location peg being formed on the pivot link; and further including a pivot stop which, in use, is attached to the face shield, the pivot stop having an hole therein through which the pivot element extends to rotatable mount the pivots top on the pivot element, and further having upper and lower recesses into which the location peg is accommodated during rotation of the pivot stop on the pivot element so as to hold the pivot stop in first and second rotational positions on the pivot element corresponding, in use, to raised and lowered positions of the face shield.

2. The device according to claim 1, wherein the pivot element includes slots for engaging a locating pin to enable angular adjustment of the face shield relative to a user's face.

3. The device according to claim 1, wherein the translational movement enables the face shield to be positioned closer to, or further from, a user's face.

4. The device according to claim 1, wherein a perimeter of the slot includes adjustment stops for guiding the user regarding a position of the face shield relative to the user's face.

5. The device according to claim 1, wherein the pivot element includes a location peg for stopping rotation of the face shield.

6. The device according to claim 1, further including a knob attached to the pivot element for tightening or loosening the headgear support device.

7. The device according to claim 1, wherein the pivot element is slidably located with the slot to enable 25 mm of translation movement of the face shield.

8. The device according to claim 1, further comprising a retaining element for retaining the pivot element in the slot to enable translational movement of the pivot element and face shield.

9. The device according to claim 8, wherein the pivot element includes slots for engaging a locating pin to enable angular adjustment of the face shield relative to a user's face.

10. A device according claim 1, wherein the pivot element has a round shoulder on which the pivot link engages.

11. A device according claim 1, wherein the pivot link includes raised portions on an internal surface of the pivot link which engage with adjustment stops associated with the slot so as to locate the pivot element in the slot relative to the headband.

* * * * *